United States Patent [19]

Wada et al.

[11] Patent Number: 5,075,724

[45] Date of Patent: Dec. 24, 1991

[54] SYSTEM FOR RECOGNIZING INTERCHANGEABLE ARTICLES

[75] Inventors: Kenichi Wada; Ken Matsubara; Kouichi Shingaki; Tomohiko Masuda; Tsukasa Yagi, all of Osaka, Japan

[73] Assignee: Minolta Camera Kabushiki Kaisha, Osaka, Japan

[21] Appl. No.: 398,775

[22] Filed: Aug. 24, 1989

[30] Foreign Application Priority Data

Aug. 26, 1988 [JP] Japan ..... 63-213374
Sep. 7, 1988 [JP] Japan ..... 63-224173

[51] Int. Cl.[5] ..... G03G 15/08; G03G 15/00

[52] U.S. Cl. ..... 355/203; 355/260; 340/825.34

[58] Field of Search ..... 355/206, 208, 246, 260, 355/203, 204, 245, 326; 340/568, 571, 572, 825.31, 825.34; 382/1; 194/328, 330

[56] References Cited

U.S. PATENT DOCUMENTS

| | | | |
|---|---|---|---|
| 3,837,741 | 9/1974 | Spencer | 355/274 |
| 4,338,017 | 7/1982 | Nishikawa | 355/274 X |
| 4,500,195 | 2/1985 | Hosono | 355/208 |
| 4,611,730 | 9/1986 | Ikesue et al. | 222/167 |
| 4,686,515 | 8/1987 | Anderson et al. | 340/572 |
| 4,744,493 | 5/1988 | Ikesue et al. | 222/167 |
| 4,803,521 | 2/1989 | Honda | 355/208 |
| 4,963,939 | 10/1990 | Kurando et al. | 355/260 |
| 4,974,020 | 11/1990 | Takamatsu et al. | 355/208 |
| 4,977,430 | 12/1990 | Florack et al. | 355/274 |
| 5,027,113 | 6/1991 | Bonnaval-Lamothe et al. | 340/825.34 |

FOREIGN PATENT DOCUMENTS

| | | | |
|---|---|---|---|
| 0261643 | 3/1988 | European Pat. Off. | 355/260 |
| 61-25168 | 2/1986 | Japan . | |
| 61-28979 | 2/1986 | Japan . | |
| 61-35468 | 2/1986 | Japan . | |
| 63-160938 | 7/1988 | Japan . | |
| 63-259672 | 10/1988 | Japan | 355/204 |

*Primary Examiner*—Joan H. Pendegrass
*Attorney, Agent, or Firm*—Joseph C. Andras

[57] ABSTRACT

A system for recognizing a detachable article attached to an apparatus, and judging whether the article as mounted in position is genuine. The article can be identified by the predetermined device, whereas the apparatus includes a detector for detecting the device. The apparatus is driven according to a result obtained by the detector. The system of the present invention is particularly suited for a toner bottle, PC unit and so on attached to a copier, printer or other image-forming apparatus.

18 Claims, 9 Drawing Sheets

SYSTEM FOR RECOGNIZING INTERCHANGEABLE ARTICLES

BACKGROUND OF THE INVENTION

1. Field of the Invention

This invention relates to a recognizing system for recognizing a detachable article and judging whether the article mounted is genuine.

Especially, this invention relates to an interchangeable article recognizing system. recognizing system. The recognizing system being operable for checking the quality or mounting state of the article or judging the interchangeable article to be genuine in which the interchangeable article may accommodate consumable materials or store informations regarding the article.

2. Description of Prior Art

Generally, the system which can demonstrate its inherit performance by attaching detachable articles has been realized in various fields.

Common problem in these articles is the existence of unauthorized and poorly efficient articles which are not genuine. Such inferior articles interrupt normal operations of apparatus to which the articles are attached.

Therefore, the system which is capable of judging whether the articles to be attached are genuine has strongly been desired. Furthermore, the system which can cope with the situation properly when the articles are not judged to be genuine has also been desired.

More particularly, such a system has especially desired when the articles contain consumptive materials.

Since these materials are generally mass-produced, it is hard to prevent quality variance of the materials caused by various production time and manufacturing plants. The articles are required to be replaced with new ones when the materials are exhausted. However, if the information concerning the materials is not fed back to the apparatus to which the articles are attached, disadvantages occur by the foregoing quality variance.

Thus, the system which can judge whether or not the articles to be attached are genuine, or in other words, whether or not the articles have sufficient quality to operate the apparatus has been desired. In addition, the system which can vary the operations of the apparatus according to judging results has been required.

The articles concerning the above-noted desired system actually extend to various fields, e.g., the articles including magnetic disks and memory elements which are attached to computers for carrying out various operations, the articles including photo-disks and magnetic films used in the audio field, automobile tires, various kinds of lighting apparatus and the like.

One of the fields which require such systems is the electrophotographic field.

Conventionally, the developer bottle, developing unit and PC unit are detachably attached to a copier, printer or the like. These articles are replaceable with new ones when exhausted.

In changing such articles used in the copier, printer or the like, it is necessary to use new replacements properly suited to the machine since characteristics vary from machine to machine.

Such consumable articles may have the same shape, but the quality of their contents, e.g. developer, often vary. Consequently, articles not suited to the machine could be mounted in error.

This problem is more complex with the toner bottle. That is, various types of electrophotographic copying machines including those capable of multicolor development have been devised, and toner bottles of the same shape may contain toners having different characteristics. In extreme cases, the color and polarity of toners, though genuine products, may vary with the time of manufacture and the manufacturing plant.

As a result, a toner bottle containing a toner of different characteristics such as in color and polarity could be attached to the machine in error, thereby replenishing the toner not suited to the machine. This gives rise to the problems of deteriorating the quality of recorded images and even causing a breakdown of the machine itself.

In recent years, various toner bottles have been developed as disclosed in Japanese Patent Publications Kokai Nos. 60-146265, 61-25168, 61-28979 and 61-35468. These toner bottles each include an identifying engagement portion or the like representing a toner color and other characteristics, in order to prevent a toner bottle containing a wrong type of toner from being attached to the machine.

However, errors of about 20% upward and downward could occur with the charge level of a toner in the manufacturing stage of the toner to be contained in the toner bottles. Because of this non-uniformity in charge level and other characteristics of the toner contained in the toner bottles, the density of images formed by the same machine can vary even where the toner bottles containing a toner having a color and other characteristics suited to that machine are used for replenishing purposes.

SUMMARY OF THE INVENTION

It is accordingly an object of this invention to prevent the inconveniences resulting from attachment of an improper interchangeable article.

Another object of this invention is to prevent the inconveniences resulting from attachment of an improper unit where a copier, printer or the like has interchangeable units.

A further object of this invention is to prevent images from being developed with a wrong toner where an interchangeable toner bottle is attached to a copier, printer or the like.

Yet another object of this invention is to enable images to be developed with the toner contained in an interchangeable toner bottle actually attached to a copier, printer or the like.

The above objects are fulfilled, according to this invention, by a system for recognizing an interchangeable article and judging whether the article as mounted in position is genuine, comprising a detection medium provided on the interchangeable article for identification purposes, detecting means for detecting the detection medium, and confirming means for evaluating detection results provided by the detecting means and judging the interchangeable article to be genuine when authenticity of the detection medium is confirmed.

Preferably, the detection medium includes a particular pattern detectable by the detecting means.

In the above construction, when the interchangeable article is correctly mounted in position, the detecting means properly detects the particular pattern provided on the article. As a result, the machine or apparatus to which the article is attached is enabled to operate by using this article.

The detecting means cannot properly detect the particular pattern when a wrong article is mounted in position or when a right article is not correctly positioned. Then the machine is prohibited from operating by using this article.

Thus, according to this invention, the machine is operable when an interchangeable article not suited to the machine is attached thereto or when a right article is not correctly mounted, since the detecting means cannot detect the pattern showing identity of the article. In this way, the invention eliminates the possibilities of a copier, printer or the like being operated with an inappropriate interchangeable article attached thereto, which would result in poor image quality or breakdown of the machine itself, and of malfunctions of the machine due to improper attachment of the interchangeable article.

In addition, the particular pattern provided on the interchangeable article may comprise a logo such as one used as a trademark. Then, a fraudulent article displaying a similar pattern may be barred from use by virtue of the trademark right. In this way, only proper articles suited for the performance of the machine may be accepted for use.

In a further aspect, this invention is applicable to an image-forming apparatus for forming images on a recording medium by using toner. In this case, the apparatus may comprise a toner holder containing replenishing toner and removably attachable to the apparatus, a memory medium provided on the toner holder for storing information regarding the toner contained in the toner holder, and means including reading means for reading the information stored in the memory medium, and setting image-forming conditions to the apparatus in accordance with the information read by the reading means.

The information stored in the memory medium may pertain to the color, polarity, charge level and various other data characteristic of the toner contained in the toner holder.

With the image-forming apparatus as constructed above, when the toner holder is attached to the apparatus, the reading means provided on the apparatus reads from the memory medium the data characteristic of the toner contained in the toner holder. The apparatus is controllable in accordance with the data read by the reading means, in a manner suited to the toner contained in the toner holder.

Consequently, there is no possibility of a different type of toner having different characteristics such as different color and polarity being inadvertently supplied to the apparatus as encountered in the prior art. The apparatus according to this invention, thus, has little or no chance of image deterioration, breakdown or malfunctions.

As distinct from the prior art, the density of images formed by this apparatus is constant even where there are variations in the characteristics such as in charge level of the toners contained in the respective toner holders or when the toner contained in a newly attached toner holder has a different charge level or other characteristic. This invention, thus, assures a constant image density at all times.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

An embodiment of this invention will be described hereinafter, in which an interchangeable article 1 comprises a developer bottle 10 containing developer 11 for attachment to a copier, printer or the like (not shown).

Figure 1:
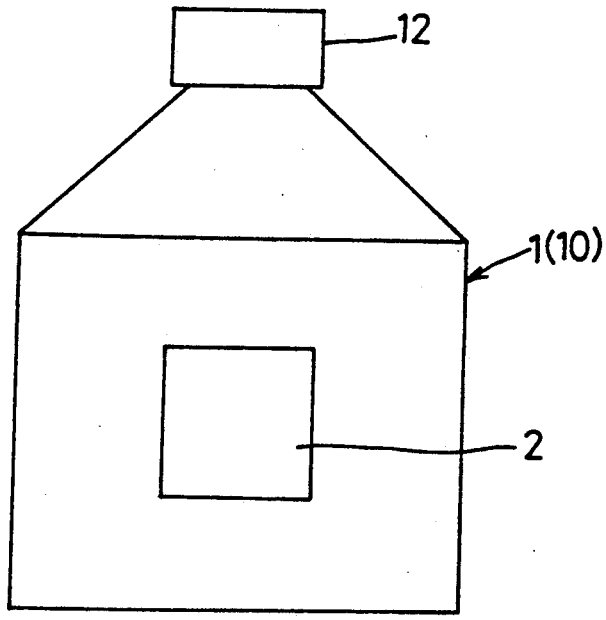
FIG. 1 is a front view of a developer bottle including an identifier having a particular pattern for use in a first embodiment of this invention.

As shown in FIG. 1, the developer bottle 10 includes a product identifier 2 provided on a peripheral position thereof. This identifier 2 has a particular pattern and acts as a medium to be detected for identification purposes. The pattern of the identifier 2 usually comprises a logo such as one used as a trademark.

In this embodiment, the pattern of the identifier 2 is metallized, has conductivity, and constitutes an electrical signal source.

Figure 2:
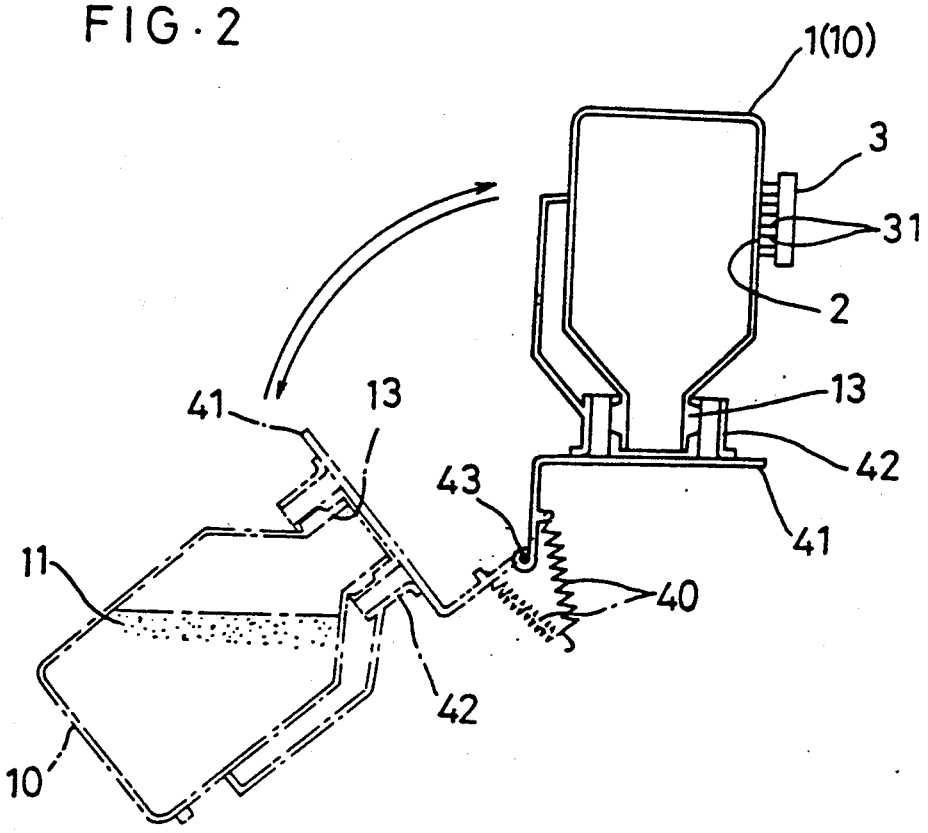
FIG. 2 is a schematic sectional view of the developer bottle as attached to a copier, printer or the like, FIG. 3 is a partial view of pin electrodes constituting a detector used in the first embodiment of this invention.
Figure 3:
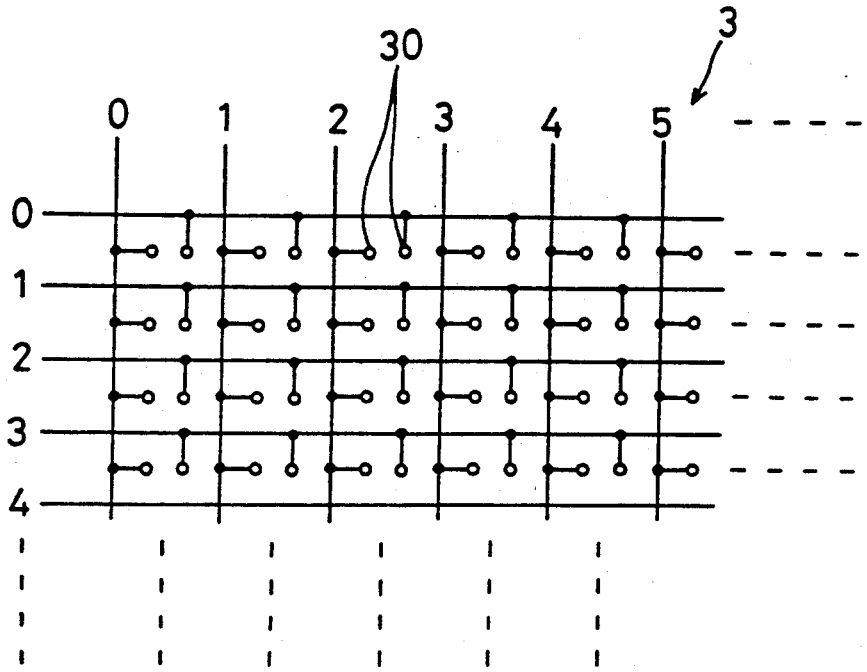

The machine to which this developer bottle 10 is attached includes a detector 3 for detecting the pattern of the identifier 2 provided on the developer bottle 10. As shown in FIGS. 2 and 3, the detector 3 comprises a plurality of pin electrodes 30 arranged at appropriate intervals in a matrix form.

For attaching the developer bottle 10 to the machine, a cap 12 is removed from the bottle 10. Then, a mouth 13 of the bottle 10 is fitted to a connector 42 supported by an L-shaped base plate 41 inclined under the force of a spring 40 as shown in dot and dash lines in FIG. 2. The base plate 41 is thereafter swung on a support axis 43 to a position for holding the developer bottle 10 upside down. The developer bottle 10 is set in position, as shown in solid lines in FIG. 2, with the base plate 41 maintained in this state by the force of spring 40.

When the developer bottle 10 is set in position as shown in the solid lines, the product identifier 2 provided on the bottle 10 is in contact with the pin electrodes 30 of the detector 3.

The pattern such as a logo shown on the identifier 2 of the developer bottle 10 is detected by conduction and non-conduction among the pin electrodes 30 of the detector 3 contacting the identifier 2. The detected pattern is compared with a pattern memorized by the machine.

When the detected pattern agrees with a reference pattern memorized by the machine, the machine is driven with the developer bottle 10 attached thereto. As a result, the developer 11 contained in the developer bottle 10 is supplied to a developing device (not shown) by a known means.

Figure 4:
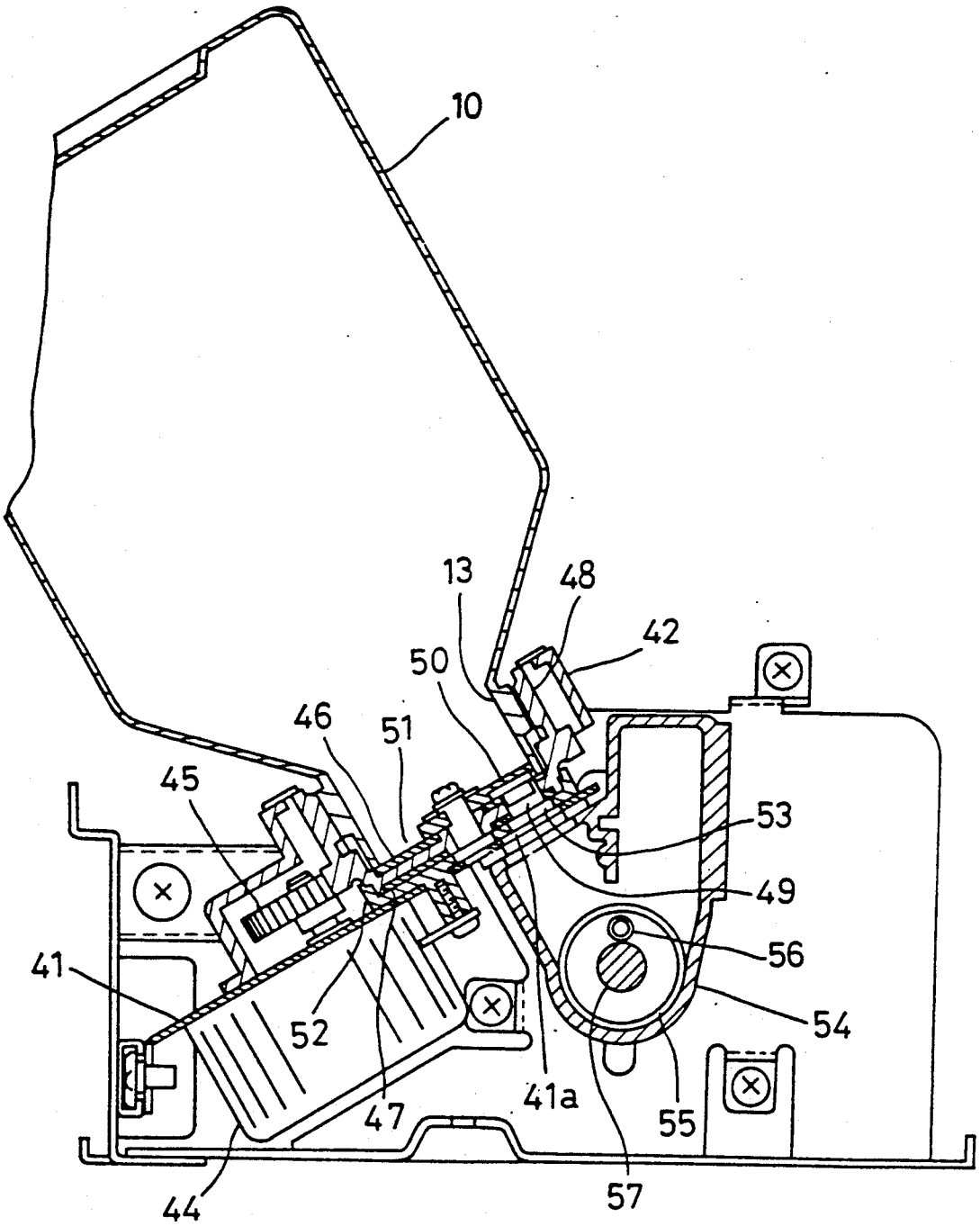
FIG. 4 is a sectional view of one example of means for supplying developer from the developer bottle in the first embodiment.

How the developer 11 is supplied from the developer bottle 10 to the developing device will be described with reference to FIG. 4. A motor 44 mounted on the base plate 41 is driven for a predetermined period. As a result, the developer bottle 10 is rotated for the predetermined period, through a gear 45 connected to the motor 44, together with a supporting ring 48 provided at the connector 42 and including a pair of upper and lower sealing plates 46 and 47.

When the supporting ring 48 including the upper and lower sealing plates 46 and 47 is rotated, an opening 49 defined in the supporting ring 48 moves to a cutout 51 defined in a metering plate 50 mounted on the supporting ring 48. Then the developer 11 is supplied from the developer bottle 10 to the opening 49 of the supporting ring 48 through the cutout 51 of the metering plate 50.

With further rotation of the supporting ring 48, a superfluous part of the developer 11 is removed by the metering plate 50 from the opening 49 of the supporting ring 48, leaving an appropriate amount of developer 11 in the opening 49 of the supporting ring 48.

Subsequently, the supporting ring 48 is rotated further in this state. When the opening 49 of the supporting ring 48 reaches a supply port 53 defined in a bottle mount 52 included in the connector 42, the developer 11 falls from the opening 49 of the supporting ring 48 through the supply port 53 and an opening 41*a* defined in the base plate 41 into a conveyer pipe 55 provided in a casing 54.

The conveyer pipe 55 houses a coil spring 56 spiraling around a shaft 57. The coil spring 56 and shaft 57 are rotatable to transport the developer 11 through the conveyer pipe 55 to the developing device.

When the developer bottle 10 containing a different type of developer 11 not suited for use with this machine is attached or when the developer bottle 10 is not set to the proper position, the pattern detected by the pin electrodes 30 of the detector 3 will not agree with the reference pattern memorized by the machine. At this time the machine is inoperable though the developer bottle 10 is attached thereto.

Where, as described above, the particular pattern on the identifier 2 of the developer bottle 10 comprises a logo used as a trademark, a developer bottle containing a developer not agreeable to the machine and illegally displaying a similar pattern may be checked as infringing the trademark right. In this way, a fraudulent developer bottle may be prevented from application to the machine. The machine is thus operable only when a proper developer bottle 10 suited for the performance of the machine is set thereto in a correct manner.

In the foregoing embodiment, the detector 3 includes a plurality of pin electrodes 30 for detecting the entire particular pattern shown on the identifier 2 of the developer bottle 10. Instead, the detector 3 of each machine may have a different arrangement of pin electrodes 30 for detecting only part of the particular pattern shown on the identifier 2 of the developer bottle 10 and comparing it with a pattern memorized by the machine. The latter has the advantage that the detector 3 requires a reduced number of pin electrodes 30, thereby lowering the cost of the machine.

Figure 5:
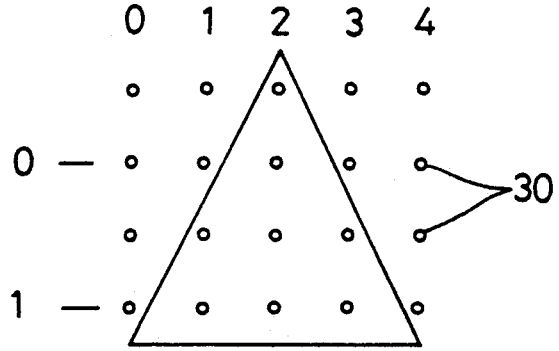
FIG. 5 is a view showing a relationship between the identifier pattern and the pin electrodes, which is one example of means for reducing the number of pin electrodes.

For example, as shown in FIG. 5, where the identifier 2 of the developer bottle 10 has conductivity only in a triangular section thereof, of pin electrodes 30 arranged horizontally as at 0 to 4 and vertically as at 0 and 1 are non-conductive among pins 0-0, 0-1, 1-0, 3-0, 4-0 and 4-1 and conductive among pins 1-1, 2-0, 2-1 and 3-1.

A certain machine may have only 0-0 pin electrodes 30, the developer bottle 10 being judged proper when these pin electrodes 30 remain non-conductive. Another machine may have only 1-1 pin electrodes 30, the developer bottle 10 being judged proper when these pin electrodes 30 become conductive.

With the arrangement of pin electrodes 30 varied from machine to machine as described above, only the developer bottle 10 having conductivity in the triangular section is workable with any machine. In this way the cost of the machines may be reduced.

Where judgment is made as to conductivity in a slected position on the identifier 2 of the developer bottle 10, an improper developer bottle 10 having no conductive portion could be judged proper depending on the positions of the pin electrodes 30 in the detector 3. It is therefore desirable for at least a conductive portion and a non-conductive portion to form a pair for making this judgment.

Thus, in the above example, the pin electrodes 30 may be arranged on the machine with at least one of the non-conductive pins 0-0, 0-1, 1-0, 3-0, 4-0 and 4-1 and one of the conductive pins 1-1, 2-0, 2-1 and 3-1 forming the pair.

Figure 6:
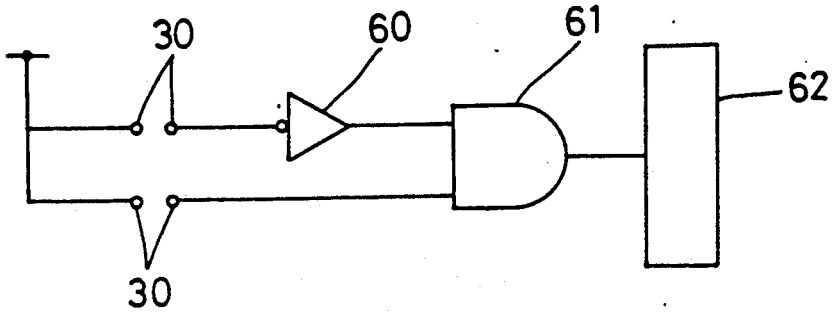
FIG. 6 is a diagram of a control circuit for controlling the pin electrodes shown in FIG. 5.

As shown in FIG. 6, a signal from the pin electrodes 30 detecting the non-conductive portion is applied through an inverter 60 to an AND gate 61, whereas a signal from the pin electrodes 30 detecting the conductive portion is applied directly to the AND gate 61. An output of the AND gate 61 is led to a microcomputer 62.

In this case, a high level signal is applied from the AND gate 61 to the microcomputer 62 only when the pattern of the product identifier 2 on the developer bottle 10 detected by the pin electrodes 30 agrees with the pattern memorized by the machine. And the machine is operable only when the high level signal is applied to the microcomputer 62.

In the foregoing embodiment, the particular pattern of the product identifier 2 on the developer bottle 10 has conductivity and this pattern is detected by the detector 3 including the pin electrodes 30. However, the detector 3 for detecting the particular pattern of the identifier 2 is not limited to the described construction.

For example, the detector 3 may comprise an image sensor such as a CCD image sensor or a MOS for reading the particular pattern of the identifier 2 on the developer bottle 10. This construction has the advantages of allowing the particular pattern of the product identifier 2 to be formed by ordinary printing and to be detected without contacting the detector 3.

Other detection mediums are possible. For instance, the particular pattern of the product identifier 2 on the developer bottle 10 may be indicated in inks having different reflection factors, the whole or part of the particular pattern being read by a detector 3 comprising an optical sensor. The particular pattern of the product identifier 2 may be read by a detector 3 utilizing a magnetic method, an electrostatic capacity method or a mechanical method in which a microswitch is operated.

Data characteristic of the developer contained in the developer bottle 10 may be stored in the product identifier 2 of the bottle 10. In this case, the data is read by the detector 3 for controlling the machine.

Another embodiment of this invention will be described hereinafter.

Figure 7:
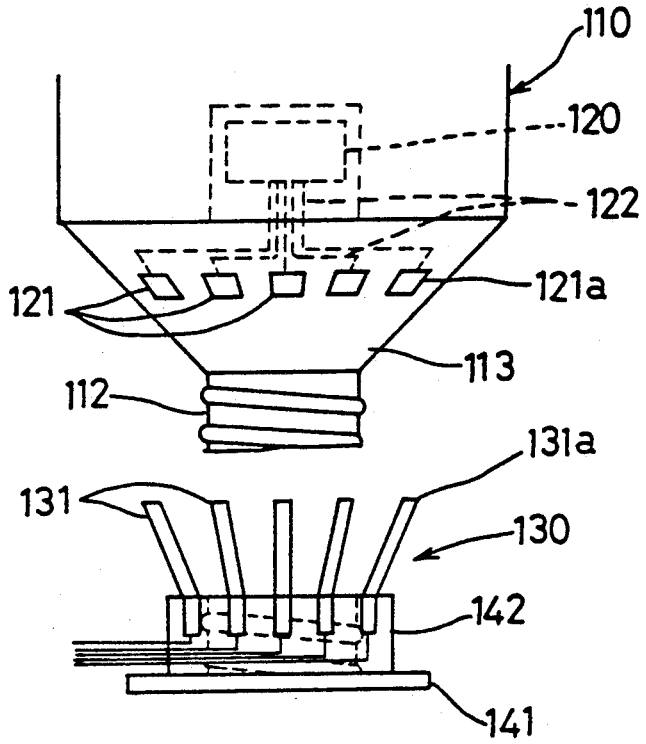
FIG. 7 is a partial front view of a toner bottle in a position prior to attachment to a copier, printer or the like according to a second embodiment of this invention.
Figure 8:
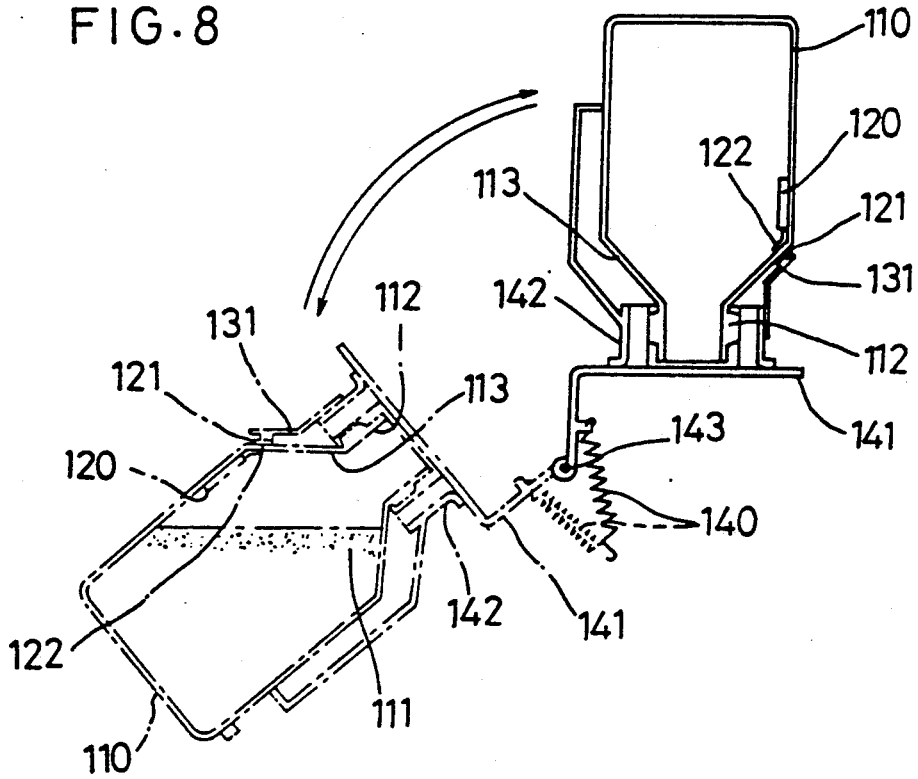
FIG. 8 is a schematic sectional view of the toner bottle of FIG. 7 as attached to the machine.

Referring to FIGS. 7 and 8, a toner bottle 110 containing toner 111 includes memory 120 mounted therein for storing data characteristic of the toner 111. The memory 120, like the identifier 2 of the first embodiment, constitutes an electrical signal source. These data include the brandname, color, polarity, charge level and so on of the toner 111. The memory 120 may be mounted on an outer periphery of the toner bottle 110, instead. It is, however, preferable for the memory 120 to be mounted inside the toner bottle 110 to be free from damage done through contact with external objects during packaging or transport.

Generally, the memory 120 may comprise a P-ROM such an a UV-EPROM or an EEPROM. Other eligible devices include a semiconductor memory such as a ONE-TIME P-ROM or an S-RAM with a battery backup, and a switching device having a fuse.

As illustrated, the toner bottle 110 further includes a plurality of electrodes 121 arranged on a tapered section 113 adjacent a mouth 112 thereof. These electrodes 121 are connected to various lines 122 including signal lines for controlling the memory 120, data lines for inputting and outputting data, and power lines for supplying power.

This toner bottle 110 is attachable to an image-forming machine such as a copier, printer or the like, with the mouth 112 of the bottle fitted to a connector 142 provided on a base plate 141. The machine comprises a reading device 130 including a plurality of reading electrode strips 131 formed of a resilient material and arranged in opposed relationship to the electrodes 121 of the toner bottle 110 for reading the toner data therefrom.

The toner bottle 110 is attached to the machine, as in the foregoing embodiment described with reference to FIG. 2, by screwing the mouth 112 of the bottle 10 onto the connector 142 with the L-shaped base plate 141 inclined under the force of a spring 140 as shown in dot and dash lines in FIG. 8. As a result, the electrodes 121 mounted on the toner bottle 110 come into pressure contact with the resilient reading electrode strips 131 arranged at the connector 141, respectively.

It is desirable, in connecting the electrodes 121 and the electrode strips 131, to avoid power supplying electrodes being connected to each other to supply power before the other electrodes are connected. Therefore, as shown in FIG. 7, where the toner bottle 110 is rotated leftward for fitting its mouth 112 to the connector 142, the electrode 121*a* and the electrode strip 131*a* disposed at the righthand ends (in FIG. 7) of the respective electrodes 121 and the electrode strips 131 are used as the power supplying electrodes since the electrode 121*a* and the electrode strip 131*a* are the last pair to be connected to each other.

After the toner bottle 110 is attached to the connector 42 with the respective electrodes 121 and 131 connected, the base plate 141 is swung on a support axis 143 to a position for holding the toner bottle 110 upside down. The toner bottle 110 is set in position, as shown in solid lines in FIG. 8, with the base plate 141 maintained in this state by the force of spring 140.

Figure 9:
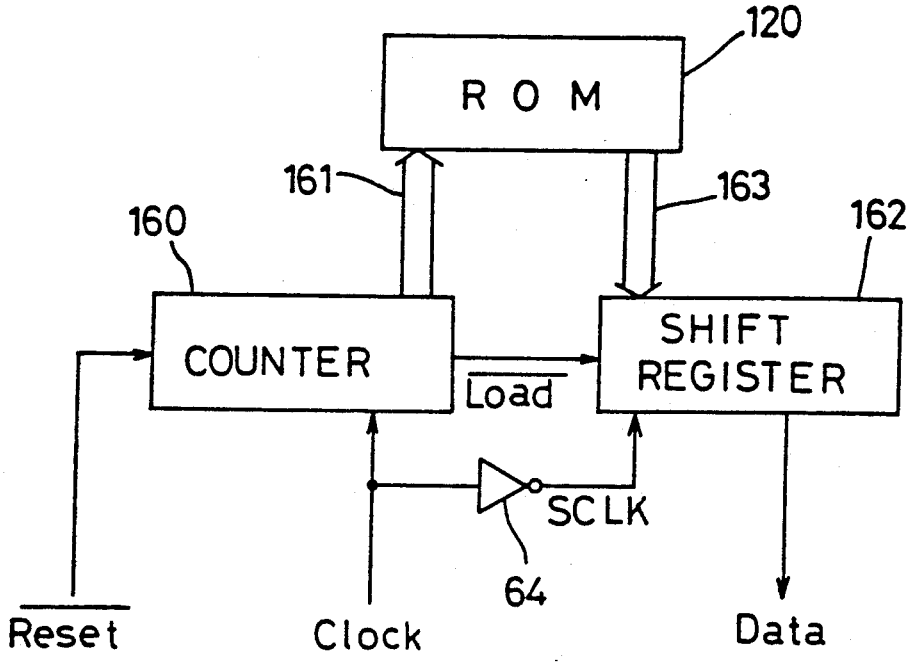
FIG. 9 is a circuit diagram showing an example where data are read from a memory included in the toner bottle according to the second embodiment.

Next, an example will be described with reference to FIGS. 9 and 10, of reading the data from the memory 120 comprising a ROM mounted in the toner bottle 110, with the respective electrodes 121 and 131 connected as described above.

When a new toner bottle 110 is fitted to the connector 142, the machine detects through a toner empty detector (not shown) that the new bottle 110 is attached thereto. In response thereto, a reset signal is applied to a counter 160 for resetting the counter 160, whereafter a clock signal is transmitted to the counter 160.

Figure 10:
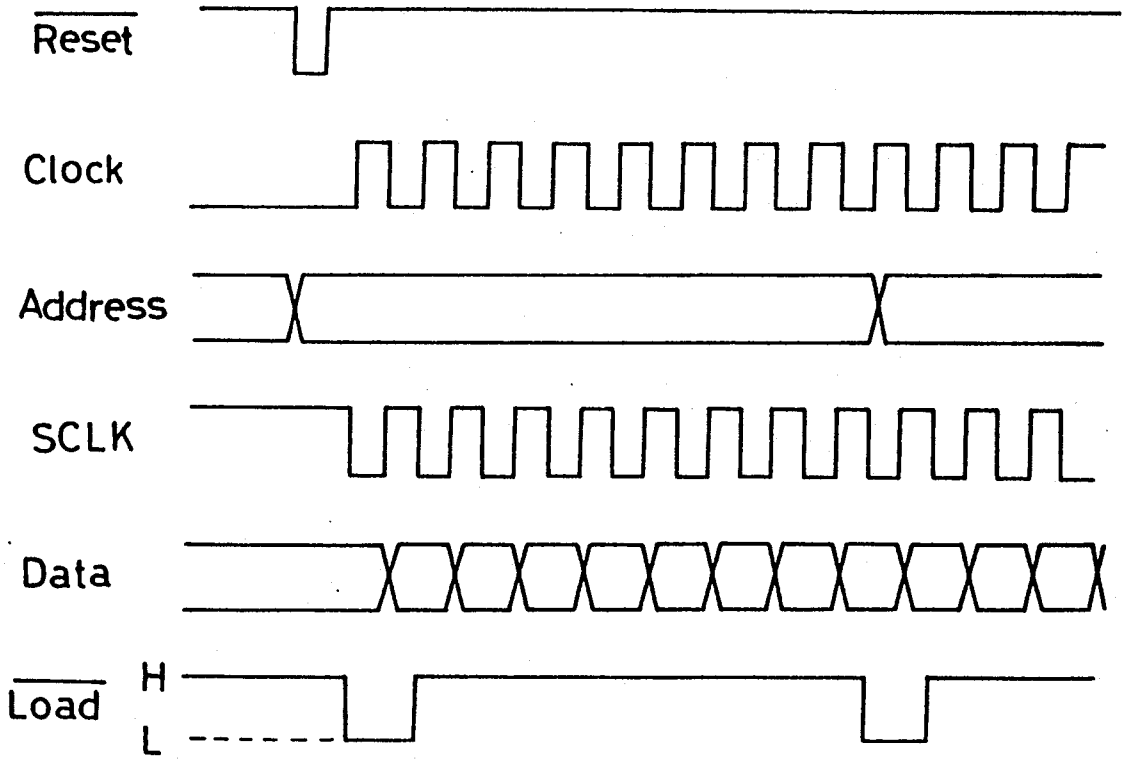
FIG. 10 is a timing chart of the data reading.

The counter 160 counts the clock pulses, and increments an address every eight pulses, for example, as shown in FIG. 10. The counter 160 transmits this address to the ROM through an address bus 61, and a low level load signal to a shift register 162.

With the address applied from the counter 160 to the ROM as above, the data designated by the address are output in parallel through a data bus 163 to the shift register 162.

The data thus output to the shift register 162 are accepted by the shift register 162 in accordance with the low level load signal transmitted from the counter 160.

Subsequently, the data accepted by the shift register 162 are output in series therefrom in synchronism with a shift clock SCLK resulting from the clock signal inverted by an inverter 164.

The machine reads the data output in series from the shift register 162 for effecting various controls.

One such control comprises stopping a copying or printing operation and giving an abnormality display and alarm when the toner 111 contained in the toner bottle 110 is found a wrong type having a different polarity, color or other feature.

Figure 11:
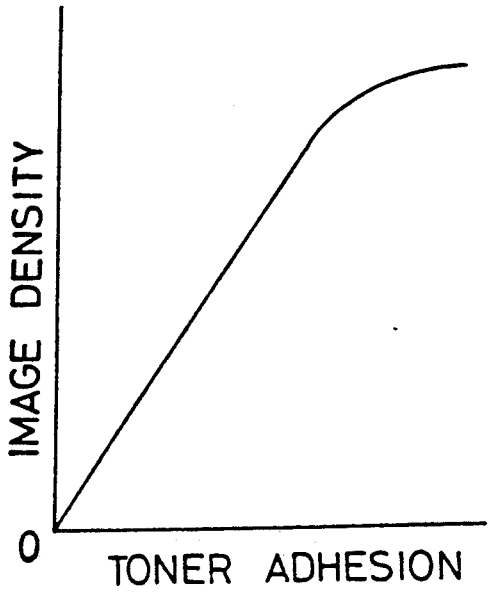
FIG. 11 is a view showing a relationship between toner adhesion and image density.

When the toner 111 contained has a different charge level, the following control is effcted in order to maintain a constant image density:

Image density and toner adhesion to a photosensitive member have a relationship as shown in FIG. 11, which may be expressed in the following formula (1):

$$Mo \propto \frac{\Delta V}{Qf} \qquad \text{(I)}$$

where Mo is an amount of toner adhesion to the photosensitive member, ΔV is a developing potential difference which is a difference between surface potential of the photosensitive material and developing bias, and Qf is a toner charge on a developing sleeve.

In the case of a two-component developer, the toner charge Qf has a relationship with toner density Tc of expressed in the following formula (II):

$$Qf \propto \frac{1}{Tc} \qquad \text{(II)}$$

Thus, in an ordinary copier, the developing potential difference ΔV and toner charge Qf are controlled to be constant to render toner adhesion Mo constant, thereby obtaining a constant image density. Toner charge Qf is controlled by maintaining toner density Tc constant where a two-component developer is used, and by regulating the toner supply to the sleeve, i.e. by selecting an appropriate regulating method of regulating member, where a one-component developer is used.

However, when the charge level of the toner 111 contained varies due to the lot difference as noted above, the toner charge Qf will change even if the toner density Tc and toner regulating method remain the same. This will result in changes in the image density.

In order to secure a constant image density, control is provided according to this embodiment for varying developing potential difference ΔV shown in the formula (I) to maintain toner adhesion Mo in the formula (I) constant. More particularly, the developing potential difference ΔV is controlled to be low when toner charge Qf decreases, and to be high when toner charge Qf increases.

Where a two-component developer is used, control is provided for varying toner density Tc shown in the formula (II) to maintain toner charge Qf in the formula (I) constant, in addition to the above control effected by varying developing potential difference ΔV. The toner adhesion Mo in he formula (I) may be maintained constant in this way to secure a constant image density.

Figure 12:
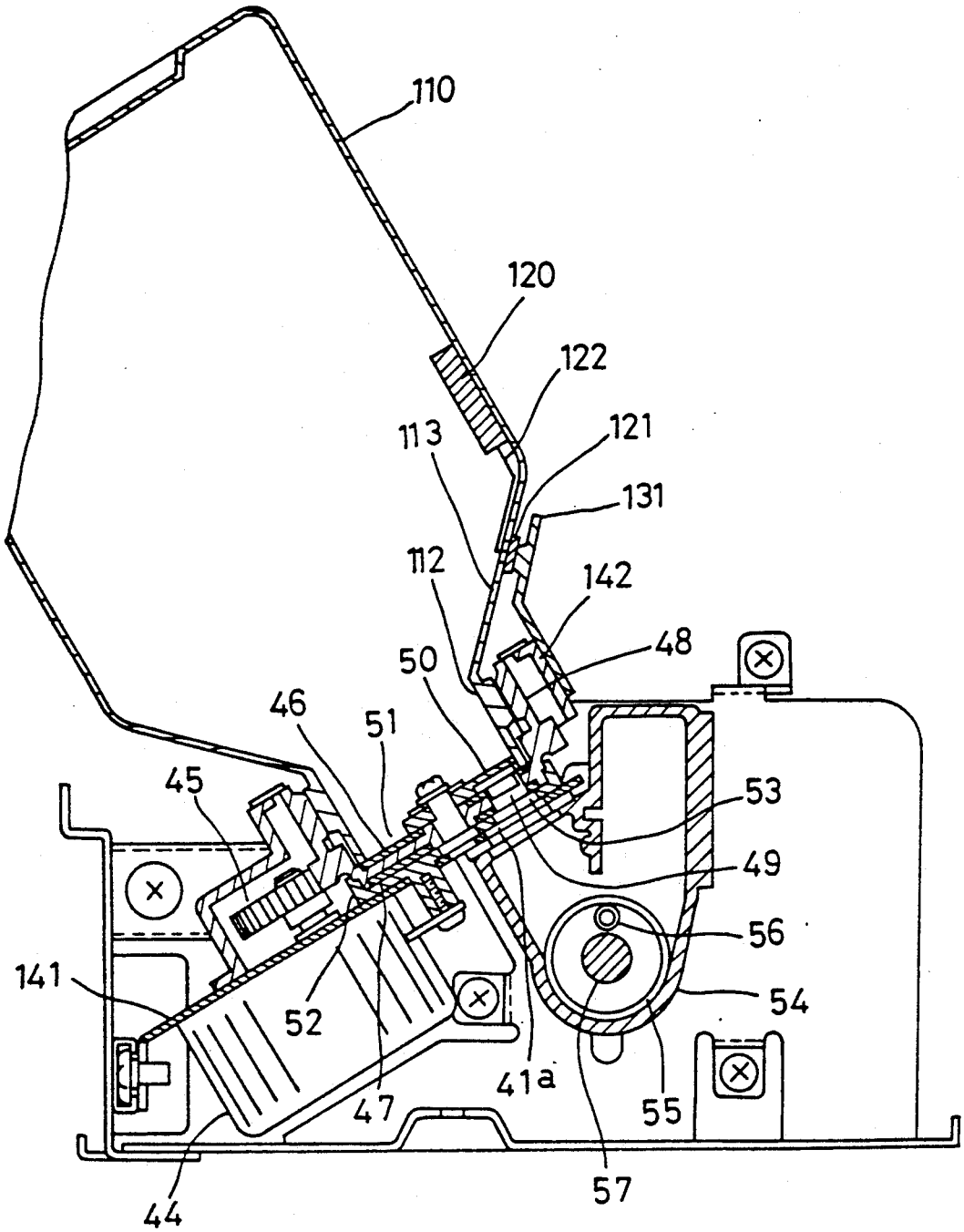
FIG. 12 is a sectional view of an example of means for supplying toner from the toner bottle.

FIG. 12 shows one example of supplying the toner from the toner bottle 110 to the developing device not shown. The illustrated construction is substantially the same as the embodiment shown in FIG. 4, the differences lying only in the toner bottle 110 substituting for the developer bottle 10 and the toner 111 substituting for the developer 11. In the following description, therefore, like parts are designated by like reference numbers and are not described again to avoid repetition.

In this embodiment, the machine to which the toner bottle 110 is attached reads the data characteristic of the toner 111 from the memory 120 mounted inside the bottle 110, such as the brandname, color, polarity, charge level and so on of the toner 111. Not only are these data read from the memory 120, but data as to the number of sheets and other data necessary for maintenance may be written into the memory 120 through the signal lines. Such data writing enables use conditions to be grasped with ease.

Figure 13:
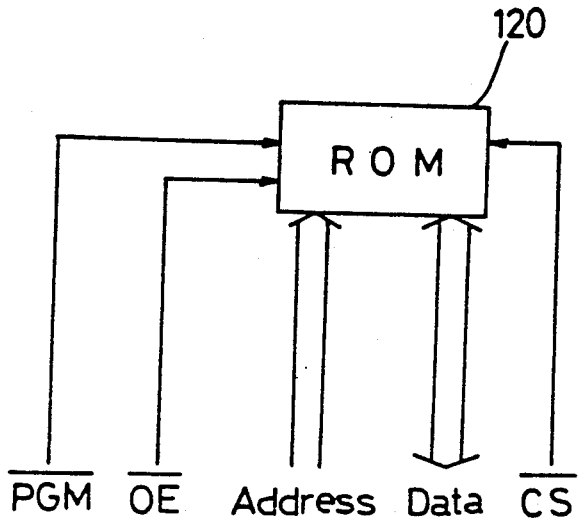
FIG. 13 is a circuit diagram showing an example where data are written into the memory included in the toner bottle.
Figure 14:
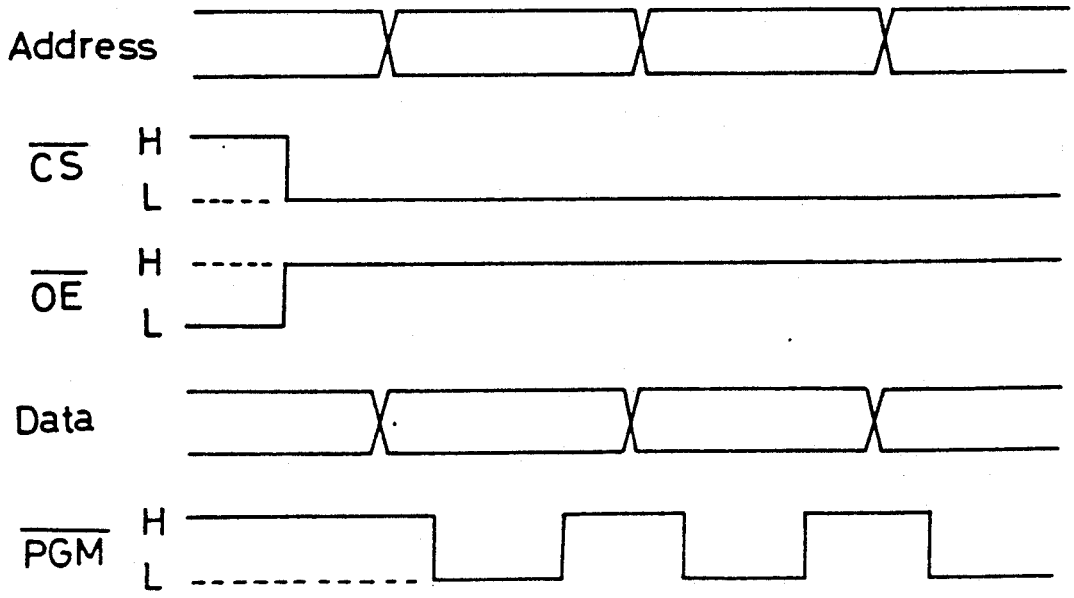
FIG. 14 is a timing chart of the data writing.

An example of data writing into the memory 120 comprising a P-ROM will be described with reference to FIGS. 13 and 14.

First addresses and data are made ready for input to the P-ROM. Then data writing is selected, as shown in FIG. 14, by changing a chip select signal CS to low level for actuating the P-ROM, and changing an output enable signal OE to high level.

In this state, a write-in signal PGM is changed to low level for writing into the P-ROM the data made ready as above along with the addresses.

Figure 15:
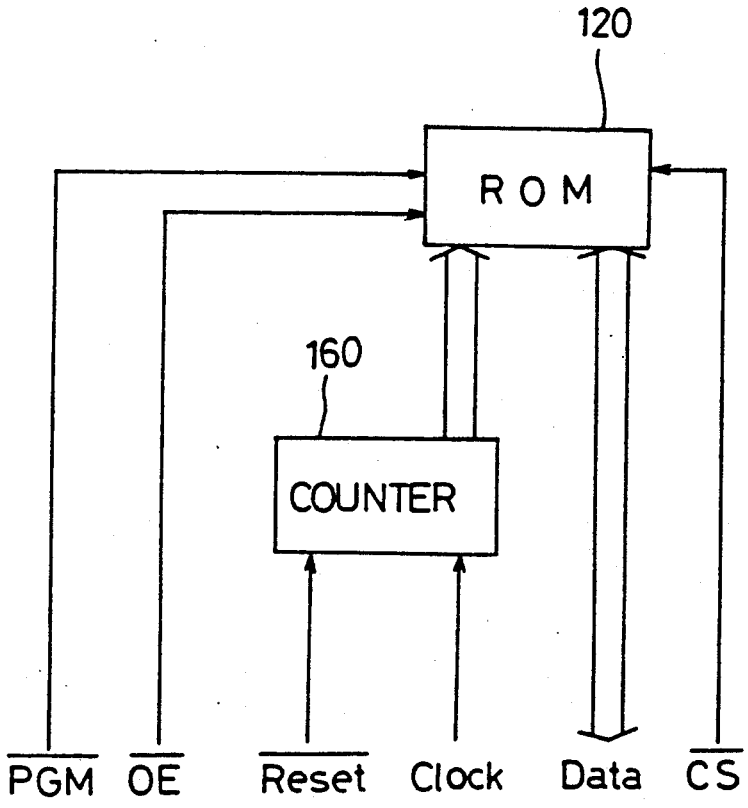
FIG. 15 is a circuit diagram showing another example of data writing into the memory included in the toner bottle.

In order to reduce the number of signal lines required for the data writing purposes, a counter 160 may be provided as shown in FIG. 15. In this case, a clock signal is applied to the counter 160 for generating addresses.

In the two embodiments described hereinbefore, the interchangeable article 1 attached to a copier, printer or the like comprises a developer bottle 10 or a toner bottle 110. However, the present invention is of course applicable to other types of interchangeable articles as well.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A system for recognizing an interchangeable article and judging whether the article as mounted in position is genuine, comprising:

a particular pattern provided on the interchangeable article for identification purposes and defined by a predetermined detection medium;

detecting means for detecting and less than the whole said particular pattern defined by said predetermined detection medium; and confirming means for judging said interchangeable article to be genuine when said detected pattern matches a prestored reference pattern.

2. A system for recognizing an interchangeable article and judging whether the article as mounted in position is genuine, comprising:

a particular pattern provided on the interchangeable article for identification purposes and defined by conductive portions and non-conductive portions;

detecting means for detecting a conductive state and/or a non-conductive state; and confirming means for judging said interchangeable article to be genuine when a pattern produced by the conductive state and/or the non-conductive state as detected by said detecting means agrees with a prestored reference pattern.

3. A system as claimed in claim 2, wherein said detecting means includes a plurality of pin electrodes for contacting said particular pattern provided on said interchangeable article to detect the conductive state and/or the non-conductive state.

4. A system as claimed in claim 3, wherein said pin electrodes detect the conductive state and/or the non-conductive state of at least two parts of said particular pattern.

5. A system as claimed in claim 2, wherein said interchangeable article is a toner bottle for use with an image-forming apparatus.

6. An image-forming apparatus for forming images on a recording medium by using toner, comprising:

a toner holder containing replenishing toner and removably attachable to a connector on said apparatus;

a memory medium provided on said toner holder for storing information regarding the toner contained in said toner holder; and means for reading the information stored in said memory medium and for setting image-forming conditions in said apparatus in accordance with the information read by said reading means, said reading means comprised of a plurality of first electrodes carried by said toner holder and electrically connected to said memory medium and a plurality of resilient electrode strips carried by and extending upward from said apparatus at or near said connector, said first electrodes coming into electrical contact with said second electrodes when said toner holder is attached to said connector.

7. An image-forming apparatus as claimed in claim 6, wherein the information stored in said memory medium includes information regarding color and/or polarity of the toner.

8. An image-forming apparatus as claimed in claim 7, wherein operation of said apparatus is prohibited when the information regarding color and/or polarity of the toner read by said reading means disagrees with pre-stored information.

9. An image-forming apparatus as claimed in claim 6, wherein the information stored in said memory medium includes at least information regarding charge of the toner and wherein a developing bias of said apparatus is shiftable in accordance with the charge of the toner read by said reading means.

10. The image-forming apparatus of claim 6, wherein said memory medium is a ROM.

11. An image-forming apparatus as claimed in claim 10, wherein said reading means includes a counter for transmitting an electric signal to said ROM, and a shift register for receiving an electric signal from said ROM.

12. A system for recognizing an interchangeable article and judging whether the article as mounted in position is genuine, comprising:

a particular pattern provided on the interchangeable article for identification purposes and defined by conductive portions and non-conductive portions;

detecting means including at least one detecting element for detecting a conductive state and/or a non-conductive state of a position corresponding to at least one selected part of said particular pattern; and confirming means for judging said interchangeable article to be genuine when a partial pattern produced by the conductive state and/or the non-conductive state as detected by said detecting means agrees with a portion of a pre-stored reference pattern.

13. A method of judging whether an interchangeable article as mounted in position is genuine, by utilizing detecting means including at least one detecting element for detecting a conductive state and/or a non-conductive state, said method comprising the steps of:

forming a particular pattern on the interchangeable article for identification purposes, said particular pattern being defined by conductive portions and non-conductive portions;

detecting, with said detecting means, the conductive state and/or the non-conductive state of a position corresponding to at least one selected part of said particular pattern;

producing a partial pattern from the conductive state and/or the non-conductive state as detected by said detecting means; and comparing said partial pattern with a portion of a pre-stored reference pattern, and judging said interchangeable article to be genuine when the partial pattern agrees with said portion of the pre-stored reference pattern.

14. A system for recognizing a detachable article and judging whether the article as mounted in position is genuine, comprising:

a particular pattern provided on the detachable article for identification purposes and defined by a predetermined detection medium;

detecting means for detecting and less than the whole of said particular pattern defined by said predetermined detection medium; and confirming means for judging said detachable article to be genuine when said detected pattern matches a prestored reference pattern.

15. A system for recognizing a detachable article and judging whether the article as mounted in position is genuine, comprising:

a particular pattern provided on the detachable article for identification purposes and defined by conductive portions and non-conductive portions;

detecting means including at least one detecting element for detecting a conductive state and/or a non-conductive state of a position corresponding to at least one selected part of said particular pattern; and confirming means for judging said detachable article to be genuine when a partial pattern produced by the conductive state and/or the non-conductive state as detected by said detecting means agrees with a portion of a pre-stored reference pattern.

16. A system for recognizing a detachable article and judging whether the article as mounted in position is genuine, comprising:

a particular pattern provided on the detachable article for identification purposes and defined by conductive portions and non-conductive portions;

detecting means for detecting a conductive state and/or a non-conductive state; and confirming means for judging said detachable article to be genuine when a pattern produced by the conductive state and/or the non-conductive state as detected by said detecting means agrees with a prestored reference pattern.

17. A system for recognizing an interchangeable article and judging whether the article as mounted in position is genuine, comprising:

a particular pattern provided on the interchangeable article for identification purposes;

detecting means for detecting one selected part of the particular pattern; and confirming means for judging the interchangeable article to be genuine when a state as detected by the detecting means agrees with a prestored reference pattern.

18. An image-forming apparatus for mounting therein an interchangeable unit comprising:

an electrical signal source for producing a predetermined electrical signal, said electrical signal source disposed on the interchangeable unit;

producing means for producing an electrical signal by electrically contacting with the electrical signal source;

mounting means for mounting the interchangeable unit at a position where the electrical signal source of the interchangeable unit is contacted with the detecting means;

varying means for varying the state concerning the image forming operation of the image-forming apparatus in accordance with the electrical signal produced by the producing means; and urging means for urging the interchangeable unit held by the holder in the direction from the first position to the second position so as to electrically contact with the electrical signal source of the interchangeable unit with the producing means with a predetermined pressure, wherein said electrical signal is produced when the electrical signal source of the interchangeable unit is electrically contacted with the producing means.

* * * * *